US010141092B2

(12) United States Patent
Bennett

(10) Patent No.: US 10,141,092 B2
(45) Date of Patent: Nov. 27, 2018

(54) POCKET HOLSTER

(71) Applicant: Charles Stuart Bennett, Mercer Island, WA (US)

(72) Inventor: Charles Stuart Bennett, Mercer Island, WA (US)

( * ) Notice: Subject to any disclaimer, the term of this patent is extended or adjusted under 35 U.S.C. 154(b) by 85 days.

(21) Appl. No.: 14/925,182

(22) Filed: Oct. 28, 2015

(65) Prior Publication Data

US 2016/0254083 A1 Sep. 1, 2016

Related U.S. Application Data

(60) Provisional application No. 62/121,683, filed on Feb. 27, 2015.

(51) Int. Cl.

| | |
|---|---|
| ***H01F 7/02*** | (2006.01) |
| ***F41C 33/02*** | (2006.01) |
| ***F41C 33/04*** | (2006.01) |
| ***A45F 5/02*** | (2006.01) |

(52) U.S. Cl.

CPC ..... *H01F 7/021* (2013.01); *A45F 5/02* (2013.01); *F41C 33/0209* (2013.01); *F41C 33/041* (2013.01); *A45F 2005/023* (2013.01); *A45F 2200/0516* (2013.01); *A45F 2200/0591* (2013.01)

(58) Field of Classification Search

CPC ..... H01K 51/0204; A45C 1/08; A45F 5/00
USPC ..... 335/285
See application file for complete search history.

(56) References Cited

U.S. PATENT DOCUMENTS 2,413,465 A * 12/1946 Ohlsen ..... A45C 3/06 132/314
2,544,493 A * 3/1951 Filenbaum ..... A45C 3/06 150/108
2,562,499 A * 7/1951 Lifton ..... A45C 3/02 190/111
D256,631 S * 9/1980 Workman ..... D3/287
D260,198 S * 8/1981 Siegel ..... D3/243
4,325,142 A * 4/1982 Nakazawa ..... H04B 1/385 455/346
4,569,082 A * 2/1986 Ainsworth ..... A45C 13/021 150/106
4,739,809 A * 4/1988 Adams ..... A45C 3/00 150/112
4,754,790 A * 7/1988 Meyers ..... A45C 3/08 150/104

(Continued)

*Primary Examiner* — Shawki S Ismail
*Assistant Examiner* — Lisa N Homza
(74) *Attorney, Agent, or Firm* — Michelle E. Carey; Telekta Law, P.S.

(57) ABSTRACT

A system for securing a device to a person by way of their clothing. Method of use is to deploy a ferromagnetic strip coupled with the device on one side of an article of clothing, and a magnet on the opposite side of the article of clothing. The ferromagnetic strip may include a recessed area to receive the magnet. The strip may be coupleable with holsters or cases for guns, phones, or other devices, such as medical devices, radios, or cameras. Some methods of use include two or more ferromagnetic strips and a magnet, wherein one strip is disposed on the surface of the device, one or more strips are disposed with the device inside a pocket or on one side of an article of clothing, and the magnet is disposed outside the pocket or on the other side of an article of clothing. Designed for low profile.

7 Claims, 6 Drawing Sheets

(56) References Cited

U.S. PATENT DOCUMENTS 5,207,254 A * 5/1993 Fromm ..... A45C 3/08 150/104
5,725,039 A * 3/1998 Macinai ..... A45C 3/08 150/104
5,749,447 A * 5/1998 Hersh ..... A45C 3/00 190/111
5,842,722 A * 12/1998 Carlson ..... B42D 15/00 283/107
5,881,787 A * 3/1999 Davis ..... A45C 13/1069 150/103
5,992,807 A * 11/1999 Tarulli ..... B60R 11/0241 248/205.3
6,070,628 A * 6/2000 Nastasi ..... A45C 13/1069 150/107
6,120,162 A * 9/2000 Guerrieri ..... A45C 15/06 362/155
6,149,116 A * 11/2000 Won ..... B60R 11/0241 224/553
6,170,131 B1 * 1/2001 Shin ..... A41F 1/002 24/303
6,179,025 B1 * 1/2001 Sutton ..... A45C 3/08 150/105
6,186,201 B1 * 2/2001 Salz ..... A45C 3/08 150/104
D441,527 S * 5/2001 Hersh ..... D3/232
6,304,162 B1 * 10/2001 Nakatsuka ..... H01F 7/02 335/302
6,364,110 B2 * 4/2002 Johnson ..... A45C 3/00 190/901
6,644,694 B2 * 11/2003 Seawright ..... B42D 15/008 2/16
6,796,344 B2 * 9/2004 Chen ..... A45C 1/024 150/113
6,888,940 B1 * 5/2005 Deppen ..... B60R 11/0241 379/446
7,806,309 B2 * 10/2010 Korchmar ..... A45C 3/06 224/183
7,845,377 B2 * 12/2010 Edwards, Jr. ..... A45C 1/024 150/131
D637,810 S * 5/2011 Romero ..... D3/233
D638,627 S * 5/2011 Romero ..... D3/318
D639,551 S * 6/2011 Romero ..... D3/233
D640,871 S * 7/2011 Romero ..... D3/318
8,109,306 B2 * 2/2012 Paulk ..... A45C 7/0059 150/114
D658,366 S * 5/2012 Platt ..... D3/233
D659,389 S * 5/2012 Platt ..... D3/233
D661,089 S * 6/2012 Seegmiller ..... D3/233
8,251,113 B2 * 8/2012 Baxter ..... A45C 1/024 150/103
8,491,191 B2 * 7/2013 Ackerman ..... B65D 33/008 383/105
8,498,100 B1 * 7/2013 Whitt, III ..... G06F 1/1618 361/679.17
D692,653 S * 11/2013 Platt ..... D3/217
8,646,971 B2 * 2/2014 Doyle ..... B65D 33/24 383/38
D702,043 S * 4/2014 Johnson ..... D3/247
8,684,054 B2 * 4/2014 Platt ..... A45C 3/08 150/100
8,739,386 B2 * 6/2014 Wein ..... A24F 15/18 206/242
8,854,799 B2 * 10/2014 Whitt, III ..... G06F 1/1618 335/219
8,936,222 B1 * 1/2015 Bastian ..... A45F 5/00 224/183
8,964,379 B2 * 2/2015 Rihn ..... G06F 1/1616 335/288
D732,829 S * 6/2015 Johnson ..... D3/318
D733,432 S * 7/2015 Johnson ..... D3/318
9,144,282 B2 * 9/2015 Leuty ..... A45C 15/06
9,157,573 B1 * 10/2015 Zach ..... B60N 3/102
2002/0153074 A1 * 10/2002 Chen ..... A45C 1/024 150/113
2004/0244096 A1 * 12/2004 Claro ..... A42B 1/22 2/195.2
2005/0139498 A1 * 6/2005 Goros ..... H04B 1/3888 206/320
2008/0100152 A1 * 5/2008 Busch ..... E05F 15/60 310/14
2009/0064395 A1 * 3/2009 Dow ..... A41D 27/08 2/244
2010/0285283 A1 * 11/2010 Kingsbury ..... A42B 1/004 428/195.1
2011/0006725 A1 * 1/2011 Wilson ..... H01M 10/465 320/101
2011/0058705 A1 * 3/2011 Lee ..... A41D 1/005 381/388
2011/0280499 A1 * 11/2011 Brundage ..... A45F 5/02 383/11
2011/0307420 A1 * 12/2011 Shaw ..... A41D 27/08 705/500
2012/0047631 A1 * 3/2012 Connolly ..... A41D 27/02 2/272
2013/0162554 A1 * 6/2013 Lauder ..... H01F 7/04 345/173
2013/0273752 A1 * 10/2013 Rudisill ..... H01R 13/6205 439/39
2014/0077911 A1 * 3/2014 Raisch ..... G06F 3/017 335/306
2014/0183066 A1 * 7/2014 Toulotte ..... H04M 1/185 206/37
2015/0068014 A1 * 3/2015 Salmon ..... H01F 7/0252 29/428

* cited by examiner

POCKET HOLSTER

PRIORITY CLAIM

This application claims the benefit of U.S. provisional patent application No. 62/121,683, filed Feb. 27, 2015. The foregoing application is incorporated in its entirety as if fully set forth herein.

FIELD OF THE INVENTION

This invention relates generally to holsters, and, more specifically, to systems and methods for carrying a device.

BACKGROUND OF THE INVENTION

There are many methods of securing valuable products available. However, historically, each known method has pitfalls. The security of some items is necessary for the protection of one's identity or even one's personal safety. For example, if a cell phone, tablet or passport is lost, the risk of identity theft and the resulting fraudulent use can result in many thousands of dollars and it can take years to reestablish credit. If a passport is lost or stolen due to a lack of secured carry, the owner may be stranded offshore, unable to board transportation home. Moreover, it could require hundreds of dollars in replacement charges and addition travel to a US embassy or consul, as well as time lost in obtaining a new passport and reapplying for visas in the passport. A mobile radio loss may result in tactical inability in emergencies as well as the owner being isolated or lost. The loss of a digital scanner may result in the loss of critical and confidential inventory information and the loss of the time taken to compile the information. Loss of a medical monitor may lead to data critical to a patient's health. Loss of a digital camera may, at the very least, rob the owner of memories, but at worst could cause law enforcement to lose valuable evidence as well as be liable to civil litigation. The loss of an audio player may cost the owner irreplaceable live recordings as well as time to download the material on the player.

Additionally, current methods of securing a firearm in existing holsters which employ snaps, strapping, hook-and-loop, and other restraint methods reduces access time to the firearm and may result in the firearm becoming entangled, leading to lost reaction time and increasing the risk of death or injury. These are just some of the problems overcome by the invention disclosed herein.

The present invention does not reduce access time to a firearm or pose an added risk of entanglement for the fire arm as it is drawn from an existing holster. Furthermore, the present invention makes it possible to secure a fire arm within a holster and secure an existing holster, with or without a fire arm, virtually anywhere on a person's clothing, apparel, accessories or other material for the purpose of concealed fire arm carry. Additionally, the present invention greatly reduces the loss of either an existing holster or fire arm due to an existing holster or fire arm accidentally exiting the wearer's clothing, apparel, accessories or other materials during normal, vigorous or even confrontational activity, any of which may result in accidental fire arm discharge, injury or death.

SUMMARY OF THE INVENTION

This invention relates generally to holsters, and, more specifically, to systems and methods for carrying a device.

The present invention does not reduce access time to a firearm or pose an added risk of entanglement for the firearm as it is drawn from an existing holster. Furthermore, the present invention makes it possible to secure a firearm, phone, medical device, or other apparatuses as discussed above, within a holster and secure the holster, with or without the device, virtually anywhere on a person's clothing, apparel, accessories or other material for the purpose of concealed, secure carry. Additionally, the present invention greatly reduces the loss of either a holster or device due to normal, vigorous or even confrontational activity, any of which may result in accidental firearm discharge, injury, or death, or the loss of valuable or irreplaceable items.

The device can be easily fitted without tools to a holstered handgun, cell phone, tablet, mobile radio, audio player, digital camera, medical monitor, digital scanner, passport or other portable item and provides unrestricted access to an item placed at any angle at a secure fixed point for open and concealed carry anywhere on the wearer's clothing material, accompanying accessory cloth material and accompanying accessory ferromagnetic material.

To secure a holstered handgun for open and concealed carry, a ferromagnetic strip may be placed directly opposite a magnet with the ferromagnetic strip and magnet separated by clothing material. The magnetic attraction between the ferromagnetic strip and the magnet may be sufficient to secure the ferromagnetic strip and the magnet at a fixed point by compressing the clothing material between the magnet and ferromagnetic strip. A second ferromagnetic strip may be attached to the holster. The magnetic attraction between the second ferromagnetic strip attached to the holster and the first ferromagnetic strip and the magnet may be sufficient to secure the holster at a fixed point on the clothing material. The magnetic attraction between the magnet, first and second ferromagnetic strips, and the ferromagnetic material in the handgun may be sufficient to secure the handgun within the holster at any angle at the same fixed point on the clothing material. A holstered handgun may be secured to a ferromagnetic surface at any angle using the magnetic attraction between the device magnet, the device ferromagnetic strip attached to the holster, the ferromagnetic properties of the handgun and the ferromagnetic surface.

To secure a cell phone, tablet, mobile radio, audio player, digital camera, medical monitor, digital scanner, passport or other portable item for open and concealed carry, a ferromagnetic strip may be placed directly opposite a magnet with the ferromagnetic strip and magnet separated by clothing material. The magnetic attraction between the ferromagnetic strip and the magnet may be sufficient to secure the ferromagnetic strip and the magnet at a fixed point by compressing the clothing material between the magnet and the ferromagnetic strip. A second ferromagnetic strip may be attached to portable item. The magnetic attraction between the second magnetic strip attached to the portable item and the first ferromagnetic strip and the magnet may be sufficient to secure the portable item at any angle at a fixed point on the clothing material. A portable item may be secured to a ferromagnetic surface at any angle using the magnetic attraction between the device magnet, the ferromagnetic strip attached to the portable item and the ferromagnetic surface. If the portable item is in a case, a third ferromagnetic strip may be attached to the case. The magnetic attraction between the magnet, first ferromagnetic strip, second ferromagnetic magnetic strip attached to the portable item and the third ferromagnetic strip attached to the case may be sufficient to secure the portable item within the case and the case and portable item in the case at the same fixed point on the clothing material. A portable item in a case may be secured to a ferromagnetic surface at any angle using the magnetic attraction between the device magnet, the ferromagnetic strip attached to portable item, the ferromagnetic strip attached to the case and the ferromagnetic surface.

In addition to the foregoing, various other methods, systems and/or program product embodiments are set forth and described in the teachings such as the text (e.g., claims, drawings and/or the detailed description) and/or drawings of the present disclosure.

The foregoing is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings.

DETAILED DESCRIPTION

This invention relates generally to holsters, and, more specifically, to systems and methods for carrying a device.

Specific details of certain embodiments of the invention are set forth in the following description and in FIGS. 1-9 to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
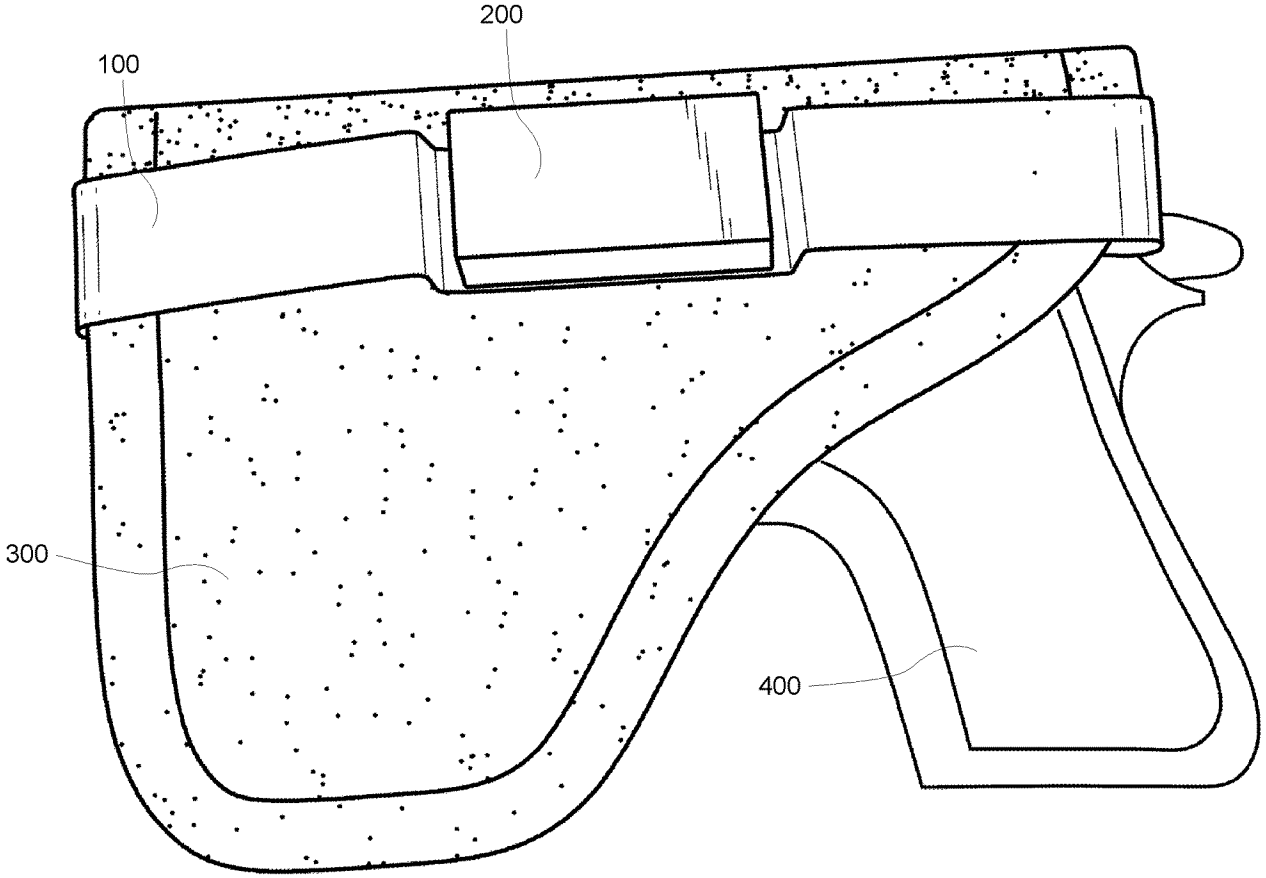
FIG. 1 is a side plan environmental view of one embodiment of the POCKET HOLSTER.

FIG. 1 is a side plan view of one embodiment of the pocket holster. The present invention is comprised essentially of a ferromagnetic area 100 and a magnet 200. In some embodiments, the system may be configured for use with a custom or standard holster 300. In some embodiments, the device 400 may be disposed within a holster 300, or may be kept within the user's pocket via a ferromagnetic nature of the device. In other embodiments, the device 400 may be permanently or removably coupled with another ferromagnetic or magnetic area, which will be discussed further with FIGS. 7, 8, and 9.

In its essential elements, the system for carrying a device is comprised of a ferromagnetic area 100. The ferromagnetic area 100 may, in some embodiments, be disposed directly on the device 400. In other embodiments, the ferromagnetic area 100 may be disposed near the device 400. In some embodiments, the ferromagnetic area 100 may be a piece of ferromagnetic material designed to be removably coupled with the device 400 or with a case 300 designed for carrying the device. In one preferred embodiment, the ferromagnetic area 100 is a somewhat elongated strip of ferromagnetic material configured to receive a magnet 200.

Figure 2:
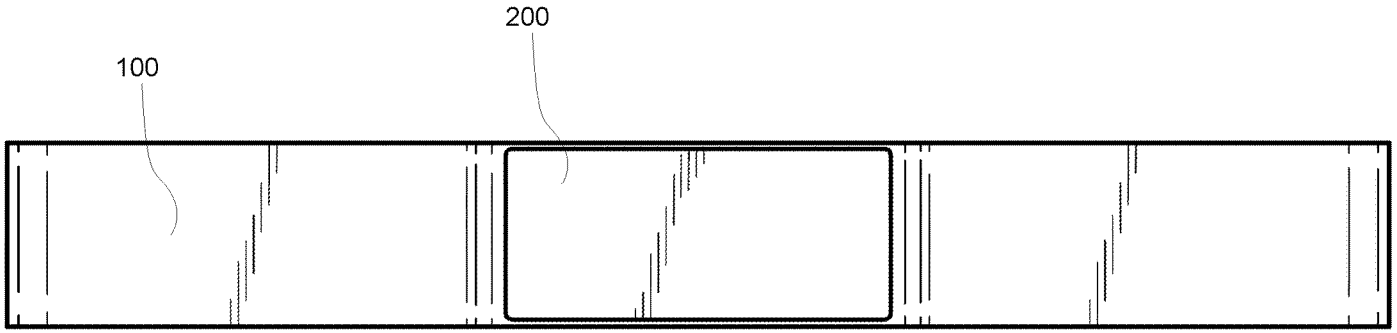
FIG. 2 is a top plan view thereof.
Figure 3:
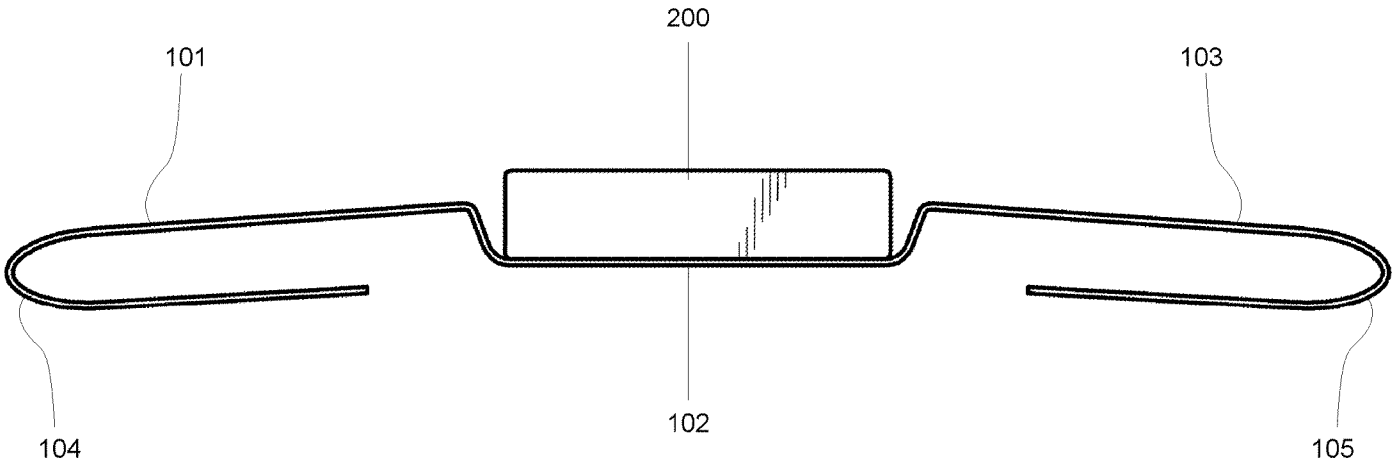
FIG. 3 is a side plan view thereof.

FIGS. 2 and 3 demonstrate this configuration more clearly. FIG. 3 illustrates that, in some embodiments, ferromagnetic area 100 is constructed with a first portion 101, a second portion 102, and a third portion 103. The embodiment shown, wherein second portion 102 is disposed approximately in the middle one-third of the upper portion of the ferromagnetic area 100, is a preferred embodiment. However, it should be noted that second portion 102 can be disposed off-center within the ferromagnetic area 100 without altering the function of the device. FIG. 3 also demonstrates that, in a preferred embodiment, second portion 102 may be recessed relative to first portion 101 and third portion 103. One purpose of the recess is to easily receive magnet 200, enabling the user to easily and quickly find the correct portion of ferromagnetic area 100 with which to pair the magnet. Another purpose of the recess is to allow the upper portion of magnet 200 to be substantially flush with the line formed by ferromagnetic area 100. The present invention may be worn with the device inside an article of clothing and the magnet 200 disposed outside the article of clothing. Recessed portion 102 allows the user to wear the device without an obvious bulge where magnet 200 is coupled with ferromagnetic strip 100. A third purpose is to form an edge against which magnet 200 can resist, preventing the ferromagnetic area 100 from moving when a device 400 is drawn from the case 300 or the ferromagnetic area.

In some embodiments, ferromagnetic area 100 ends at the ends of portions 101 and 103, where FIG. 3 shows a curve to the ferromagnetic area. In other embodiments, ferromagnetic area 100 includes grip areas 104 and 105, respectively. In such an embodiment, ferromagnetic area 100 can be disposed around the upper and lower portions of a case 300, such as a gun holster or case for a phone or medical device, by inserting the upper edge into one of grip 104 or 105, and the lower edge into the other of grip 104 or 105. See FIG. 1, FIG. 5, and FIG. 6 for examples of such an embodiment. In some embodiments, grips 104 and 105 may be removably coupled with ferromagnetic area 100. In other embodiments, grips 104 and 105 may be formed by curving ferromagnetic area 100 under itself to form recesses, as shown in FIG. 3. In some embodiments, grips 104 and 105 may include a higher friction material, such as a rubber or plastic coating, to enable better coupling with a case 300. In some embodiments, the entirety of ferromagnetic area 100 may be coated with a higher friction material in order to better grip the device 400, or with other coatings such as a noncorrosive coating or a color coating.

Figure 5:
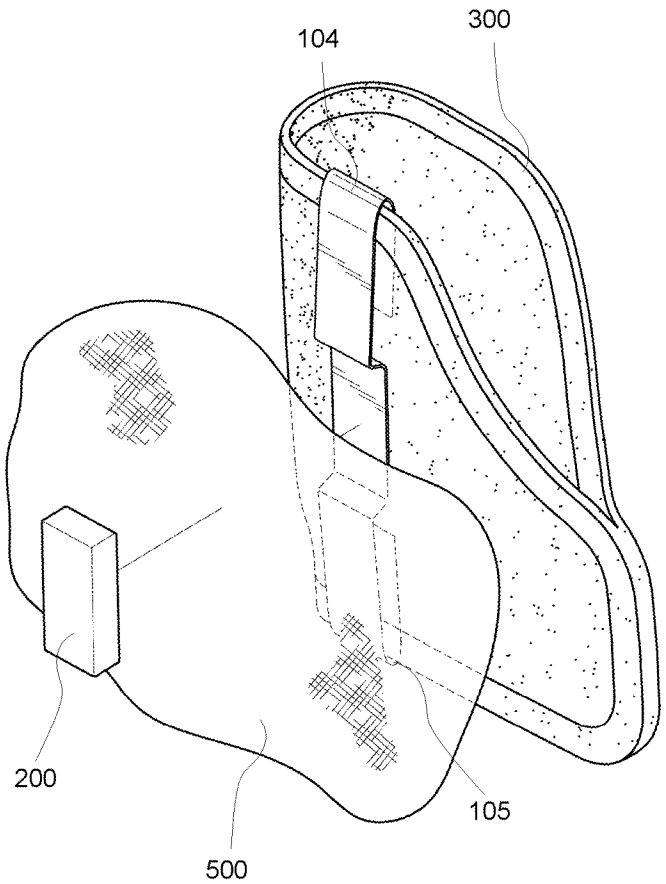
FIG. 5 is an exploded environmental view thereof.
Figure 4:
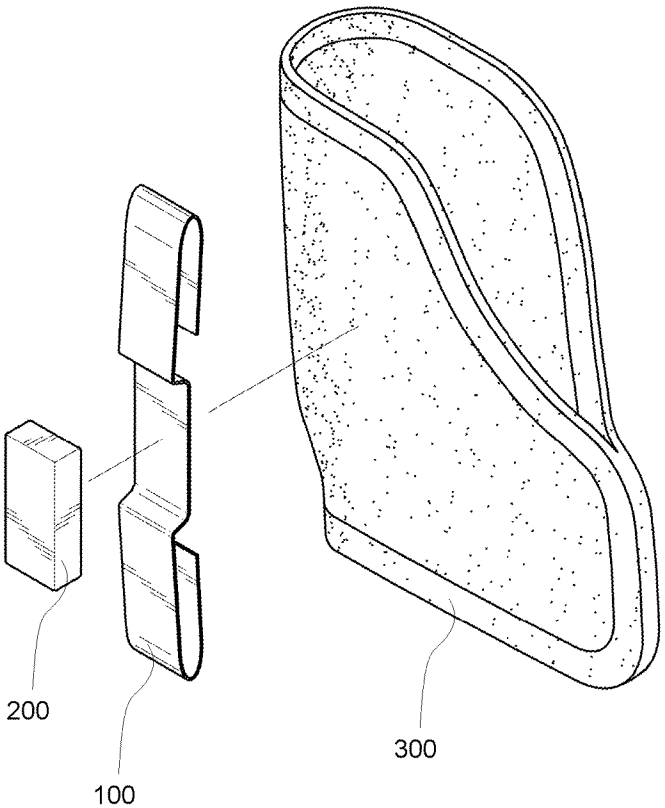
FIG. 4 is an exploded view thereof.
Figure 6:
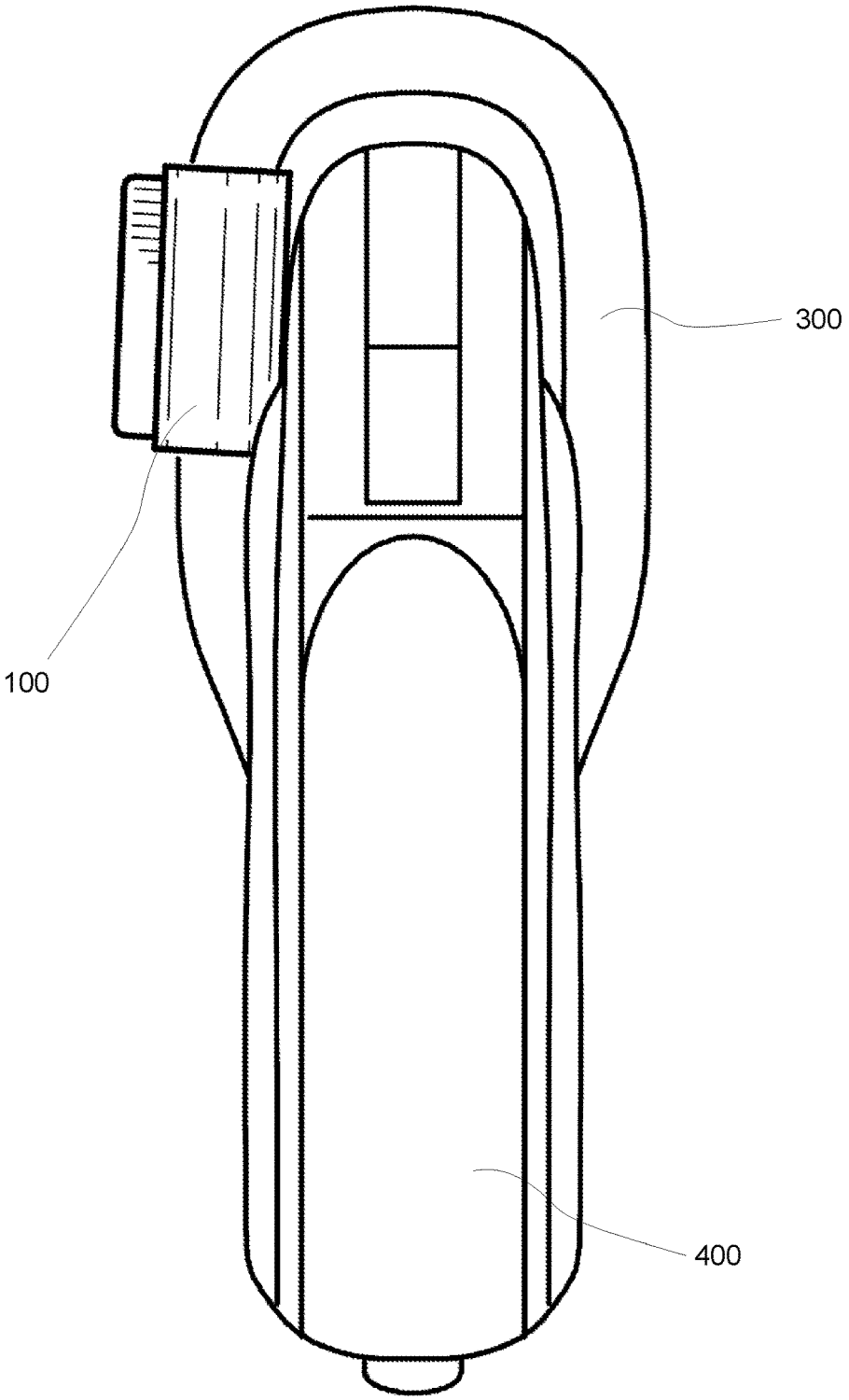
FIG. 6 is a rear plan view thereof.

FIGS. 4 and 5 show one preferred embodiment of the present invention as it is coupled with a case 300. FIG. 4 is an exploded view showing magnet 200, ferromagnetic area 100, and case 300. FIG. 5 shows that the ends of case 300 are disposed within grips 104 and 105, allowing the ferromagnetic area 100 to be snugly disposed around case 300. FIG. 5 also shows one method of employing the present invention. Here it can be seen that ferromagnetic area 100 is disposed around case 300, and then a piece of material 500, such as a piece of clothing, is disposed between magnet 200 and the ferromagnetic area. One non-limiting example of this might be when a user wishes to conceal his or her weapon in a pocket. The user would insert the device 400 into case 300, insert case 300 into ferromagnetic area 100, and put the case and ferromagnetic area into a pocket. Then the user would place magnet 200 into the recessed portion of ferromagnetic area 100, holding the case 300 firmly within the pocket. If the user then decided to draw his or her weapon, magnet 200 would hold case 300, and ferromagnetic area 100 in place within the pocket. FIG. 6 is a rear view example of such a method, showing that ferromagnetic area 100, when properly disposed around case 300, does not interfere with the placement or drawing of a device (weapon) 400.

Figure 7:
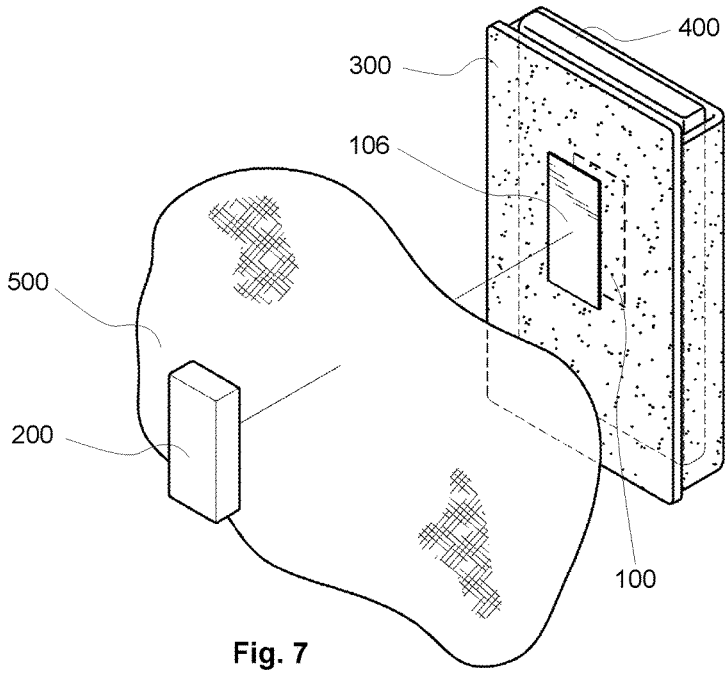
FIG. 7 is an exploded environmental view of one different embodiment of the POCKET HOLSTER.
Figure 8:
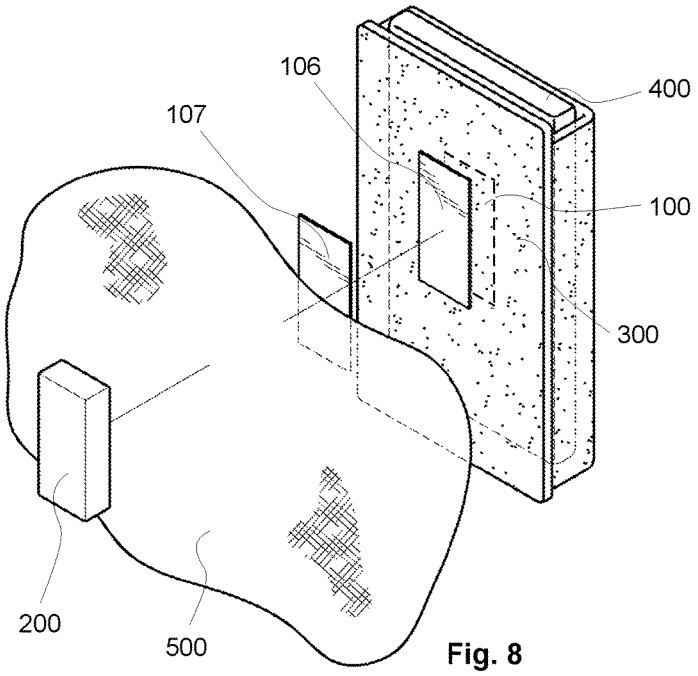
FIG. 8 is an exploded environmental view of another different embodiment of the POCKET HOLSTER.

FIG. 7 is an illustration of a similar method with a device such as a phone, music player, or medical device. The device 400 is coupled with first ferromagnetic area 100, and is inserted into case 300, which is coupled with second ferromagnetic area 106. While the ferromagnetic area 106 is shown here as a single flat area, it should be noted that, as above, the area may be a flat area, but it may also be an area with at least one recessed portion. Case 300 is inserted into a pocket or tucked within a jacket, for example, causing a piece of material 500 to come between ferromagnetic area 106 and magnet 200. This secures the device 400 to the clothing 500 without restricting access to the device. Ferromagnetic area 100 holds the device within the case, and ferromagnetic area 106 allows removal of the device without causing magnet 200 to fall away from the user. It should be noted that, in some embodiments, case 300 may be customized. For instance, if device 400 is something with which magnets would interfere, case 300 may be configured to protect the device from the magnetic field created by magnet 200. Alternatively, FIG. 8 shows a method with a third ferromagnetic area 107, wherein the third ferromagnetic area 107 allows removal of the device 400 and the case 300, without magnet 200 falling away.

Figure 9:
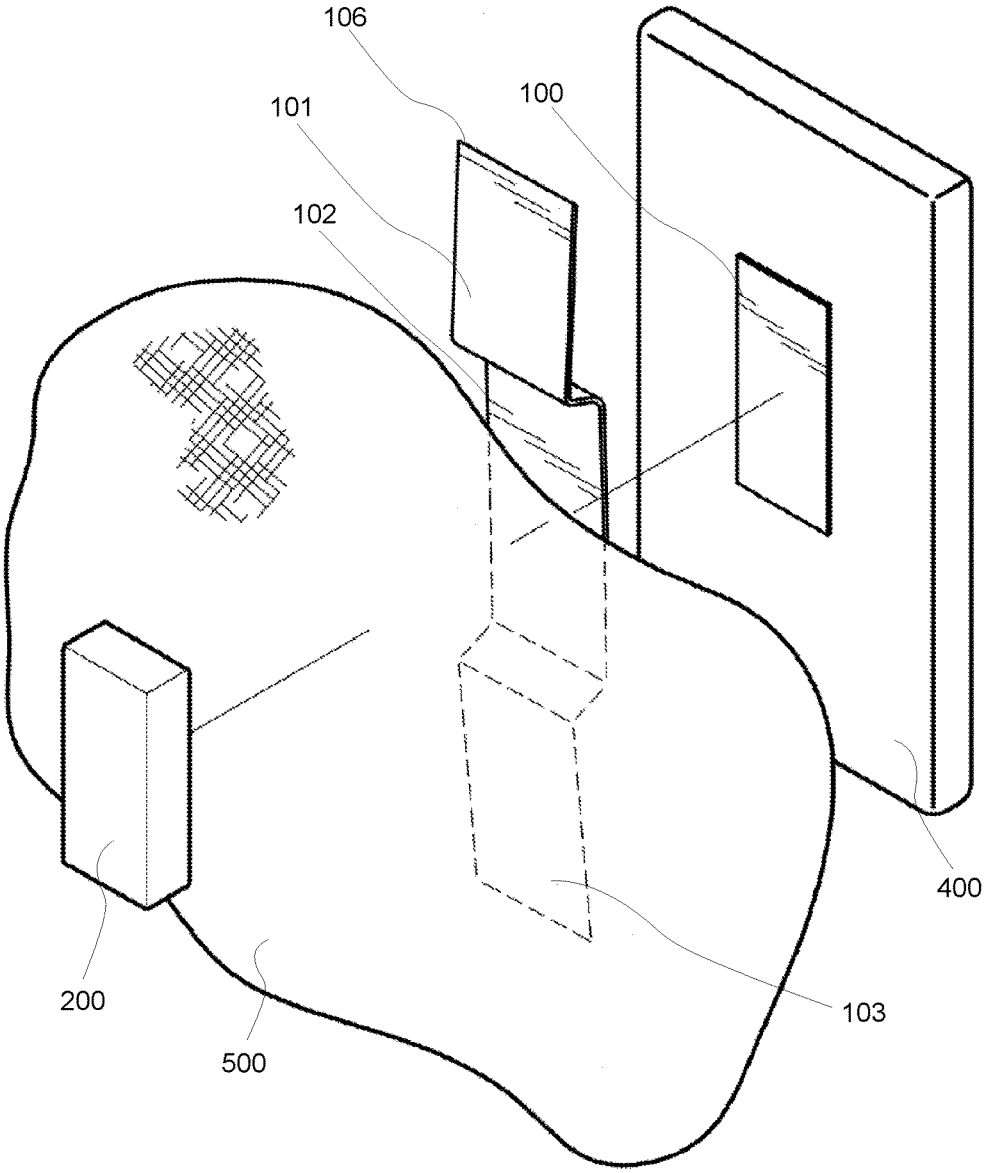
FIG. 9 is an exploded environmental view of another different embodiment of the POCKET HOLSTER.

FIG. 9 is an illustration of such a method without use of a case. In this method, first ferromagnetic area 100 may be disposed directly onto device 400. In some embodiments, this may be a permanent coupling. In some embodiments, it may be a removable coupling, such as with a temporary adhesive. In some embodiments, the ferromagnetic area may actually be two separate portions of ferromagnetic material, a first 100 coupled directly with the device, and a second ferromagnetic area 106 configured to interact with the first, coming between the device 400 and the fabric 500. This type of embodiment would prevent the magnet 200 from falling away when device 400 is removed from the clothing 500. FIG. 9 illustrates that, in some embodiments, ferromagnetic area 106 is constructed with a first portion 101, a second portion 102, and a third portion 103. The embodiment shown, wherein second portion 102 is disposed approximately in the middle one-third of the upper portion of the ferromagnetic area 106, is a preferred embodiment. However, it should be noted that second portion 102 can be disposed off-center within the ferromagnetic area 106 without altering the function of the device. FIG. 9 also demonstrates that, in a preferred embodiment, second portion 102 may be recessed relative to first portion 101 and third portion 103, which may be substantially coplanar. One purpose of the recess is to easily receive magnet 200, enabling the user to easily and quickly find the correct portion of ferromagnetic area 106 with which to pair the magnet. Another purpose of the recess is to allow the upper portion of magnet 200 to be substantially flush with the line formed by ferromagnetic area 106. The present invention may be worn with the device inside an article of clothing and the magnet 200 disposed outside the article of clothing. Recessed portion 102 allows the user to wear the device without an obvious bulge where magnet 200 is coupled with ferromagnetic strip 100. A third purpose is to form an edge against which magnet 200 can resist, preventing the ferromagnetic area 106 from moving when a device 400 is drawn from the case 300 or the ferromagnetic area.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., " a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A system for carrying a device, comprising:

at least one first ferromagnetic area disposed on at least one surface of the device;

at least one second ferromagnetic area configured to interact with the at least one first ferromagnetic area, the at least one second ferromagnetic area including at least:

a first raised area;

a second recessed area; and a third raised area, wherein the first and third raised areas are substantially co-planar; and at least one magnet configured to be removably received by the at least one second ferromagnetic area, the at least one magnet configured to fit within the second recessed area.

2. The system for carrying a device of claim 1, wherein the at least one second recessed area is configured to receive a specific shape of the at least one magnet.

3. The system for carrying a device of claim 1, wherein the at least one ferromagnetic area is removably coupled with the device.

4. The system for carrying a device of claim 1, wherein the at least one ferromagnetic area is permanently coupled with the device.

5. The system for carrying a device of claim 1, wherein the at least one second ferromagnetic area is configured to receive the at least one first ferromagnetic area.

6. The system for carrying a device of claim 5, wherein the at least one second ferromagnetic area is configured to receive the at least one magnet on at least one first side of the at least one second ferromagnetic area, and wherein the at least one second ferromagnetic area is configured to receive the at least one first ferromagnetic area on at least one second side of the at least one second ferromagnetic area, wherein the at least one second side is opposing the at least one first side of the at least one second ferromagnetic area.

7. The system for carrying a device of claim 5, wherein the first raised area, second recessed area, and third raised area are substantially aligned such that the at least one ferromagnetic area resembles a rectangular strip.

* * * * *